US006646614B2

(12) United States Patent
Killen

(10) Patent No.: US 6,646,614 B2
(45) Date of Patent: Nov. 11, 2003

(54) MULTI-FREQUENCY BAND ANTENNA AND RELATED METHODS

(75) Inventor: William Dean Killen, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/045,347

(22) Filed: Nov. 7, 2001

(65) Prior Publication Data

US 2003/0085846 A1 May 8, 2003

(51) Int. Cl.[7] ..... H01Q 21/00
(52) U.S. Cl. ..... 343/725; 343/853; 343/893
(58) Field of Search ..... 343/725, 893, 343/711, 713, 818, 835, 833, 824, 845, 727

(56) References Cited

U.S. PATENT DOCUMENTS

| | | | | | |
|---|---|---|---|---|---|
| 4,733,245 | A | | 3/1988 | Mussler | 343/769 |
| 5,444,453 | A | | 8/1995 | Lalezari | 343/700 MS |
| 5,489,914 | A | * | 2/1996 | Breed | 343/818 |
| 5,652,631 | A | * | 7/1997 | Bullen et al. | 343/872 |
| 5,838,282 | A | * | 11/1998 | Lalezari et al. | 343/727 |
| 5,898,408 | A | | 4/1999 | Du | 343/715 |
| 6,127,987 | A | * | 10/2000 | Maruyama et al. | 343/835 |
| 6,140,972 | A | | 10/2000 | Johnston et al. | 343/725 |
| 6,172,651 | B1 | | 1/2001 | Du | 343/850 |
| 6,288,681 | B1 | | 9/2001 | Kim et al. | 343/702 |

* cited by examiner

*Primary Examiner*—James Clinger
(74) *Attorney, Agent, or Firm*—Allen, Dyer, Doppelt, Milbrath & Gilchrist, P.A.

(57) ABSTRACT

A multi-frequency band antenna may include a base and a first antenna array including a plurality of spaced apart monopole antenna elements extending outwardly from the base a first distance for operating at a first frequency. Further, the multi-frequency band antenna may also include a second antenna array including a plurality of spaced apart antenna elements arranged outside the first antenna array and extending outwardly from the base a second distance less than the first distance. The second antenna array may be for operating at a second frequency lower than the first frequency.

49 Claims, 4 Drawing Sheets

MULTI-FREQUENCY BAND ANTENNA AND RELATED METHODS

FIELD OF THE INVENTION

The present invention relates to the field of communications, and, more particularly, to antennas and related methods.

BACKGROUND OF THE INVENTION

Over the past several years there has been an ever increasing number of frequency bands used for wireless applications. For example, mobile telephones now operate over numerous frequency bands including a variety of cellular frequencies (i.e., in the 800 MHz range) and the personal communications service (PCS) band (i.e., around 1900 MHz).

Since antenna systems are typically configured differently depending upon their intended operating frequency bands, multiple antenna systems would generally be required to monitor and/or communicate over as many frequency bands. This may be an inconvenience for law enforcement and emergency personnel as well as others who need to use multiple frequency bands and would otherwise have to mount multiple antennas on their vehicles to do so.

As a result, some prior art antennas have been designed that may be used with multiple frequency bands. By way of example, U.S. Pat. No. 6,172,651 to Du discloses a window mount vehicle antenna assembly which operates in two frequency bands (e.g., around 800 MHz and 1800 MHz). The antenna assembly includes an inside coupling component mounted on an inside surface of the glass, an outside coupling component mounted on an outside surface of the glass, and a whip antenna element mounted on the outside coupling component. While such antennas may provide increased convenience in that they allow for the use of multiple frequency bands, they may be disadvantageous in certain applications because of the relatively high profile of the relatively long whip antenna element.

Another advantageous feature that may be needed for law enforcement and emergency applications, for example, is the ability to perform direction finding. That is, it may be desirable to locate the direction from which a signal in a particular frequency band is emanating. To do so, an antenna system will require the ability to provide multidirectional beam patterns.

An example of such an antenna is disclosed in U.S. Pat. No. 6,140,972 to Johnston et al. This antenna includes a plurality of radiating elements mounted on a round conducting ground plane. Multiple reflecting surfaces each having a shape of one quarter of a circle or an ellipse are radially disposed about the center of the round ground plane conductor to give a hemispherical shape with multiple equal sectors. Each sector of the antenna includes two types of radiating elements mounted adjacent to the corner of the reflector. The first elemental antenna is responsive to energy having a first polarization, while the second elemental antenna is responsive to energy having a polarization orthogonal to the first polarization. Yet, this antenna has a single operating frequency, and multiple numbers of these antennas would be required to access multiple frequency bands. Further, the use of corner reflectors may increase the overall height profile of the antenna.

Other similar prior art antennas have also been developed which do operate in dual frequency bands. For example, such antennas may include an inner array of monopole antenna elements for operating in the higher of two frequency bands, and an outer array of monopole antenna elements for operating in the lower frequency band. Yet, if the outer array of monopole antenna elements it too tall, it can cause interference (i.e., scattering) with the inner antenna array, which can result in undesirable side lobes in the received signal. Accordingly, the inner antenna arrays of such antennas are generally relatively tall, or even mounted on a raised platform to avoid such interference. As a result, the profile of such antennas may again be too tall for certain applications.

SUMMARY OF THE INVENTION

In view of the foregoing background, it is therefore an object of the present invention to provide a multi-frequency band antenna which has a relatively low profile and which allows direction finding.

This and other objects, features, and advantages in accordance with the present invention are provided by a multi-frequency band antenna including a base and first and second antenna arrays. The first antenna array may include a plurality of spaced apart monopole antenna elements extending outwardly from the base a first distance and for operating at a first frequency. Further, the second antenna array may include a plurality of spaced apart antenna elements arranged outside the first antenna array and extending outwardly from the base a second distance less than the first distance. The second antenna array may be for operating at a second frequency lower than the first frequency. Accordingly, the above noted interference problem is significantly reduced, thus reducing the production of undesirable side lobes.

More particularly, each antenna element of the second antenna array may be an annular slotted antenna element. Furthermore, the monopole antenna elements of the first antenna array and the antenna elements of the second antenna array may be omni-directional antenna elements.

Additionally, the base may include an electrically conductive ground plane, and each antenna element of the second antenna array may include a conductive layer and a shaft connecting a medial portion of the conductive layer to the ground plane. Moreover, each antenna element of the second antenna array may further include a feed conductor connected adjacent a peripheral edge of the conductive layer. Each antenna element of the second antenna array may also include a dielectric material (e.g., air or plastic) between an underside of the conductive layer. The conductive layer may have a generally circular shape, for example.

Further, the base may have an upper planar surface so that a lower end of the shaft is in a generally common plane with a lower end of the monopole antenna elements. The multi-frequency band antenna may also include an impedance matching device carried by the base and connected to each antenna element of the second antenna array. Accordingly, blocking or scattering of the higher frequency signals is further reduced.

The plurality of monopole antenna elements of the first antenna array may be arranged at first vertices of a first imaginary regular polygon. Similarly, the plurality of antenna elements of the second antenna array may also be arranged at second vertices of a second imaginary regular polygon concentric with the first imaginary regular polygon. Moreover, the first and second vertices may be equal in number, and the first and second imaginary polygons may be angularly offset from one another.

In addition, the base may include an electrically conductive material to serve as a ground plane for the first and second antenna arrays. A radome may also be included for covering the first and second antenna arrays. Also, a plurality of first controllable phase shifters may be carried by the base for controlling phases of the monopole antenna elements of the first antenna array. Similarly, a plurality of second controllable phase shifters may be carried by the base for controlling phases of the antenna elements of the second antenna array.

A method aspect of the invention is for making a multi-frequency band antenna and may include mounting a plurality of monopole antenna elements on a base in spaced relation and extending outwardly from the base a first distance to form a first antenna array. The first antenna array may be for operating at a first frequency. Furthermore, the method may also include mounting a plurality of antenna elements on the base in spaced relation outside the first antenna array and extending outwardly from the base a second distance less than the first distance to form a second antenna array. The second antenna array may be for operating at a second frequency lower than the first frequency.

Yet another method aspect of the invention is for making a multi-frequency band antenna which may include mounting a plurality of monopole antenna elements in spaced relation on a base and extending outwardly therefrom to form a first antenna array. The method may further include mounting a plurality of annular slotted antenna elements in spaced relation outside the first antenna array on the base and extending outwardly therefrom to form a second antenna array.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
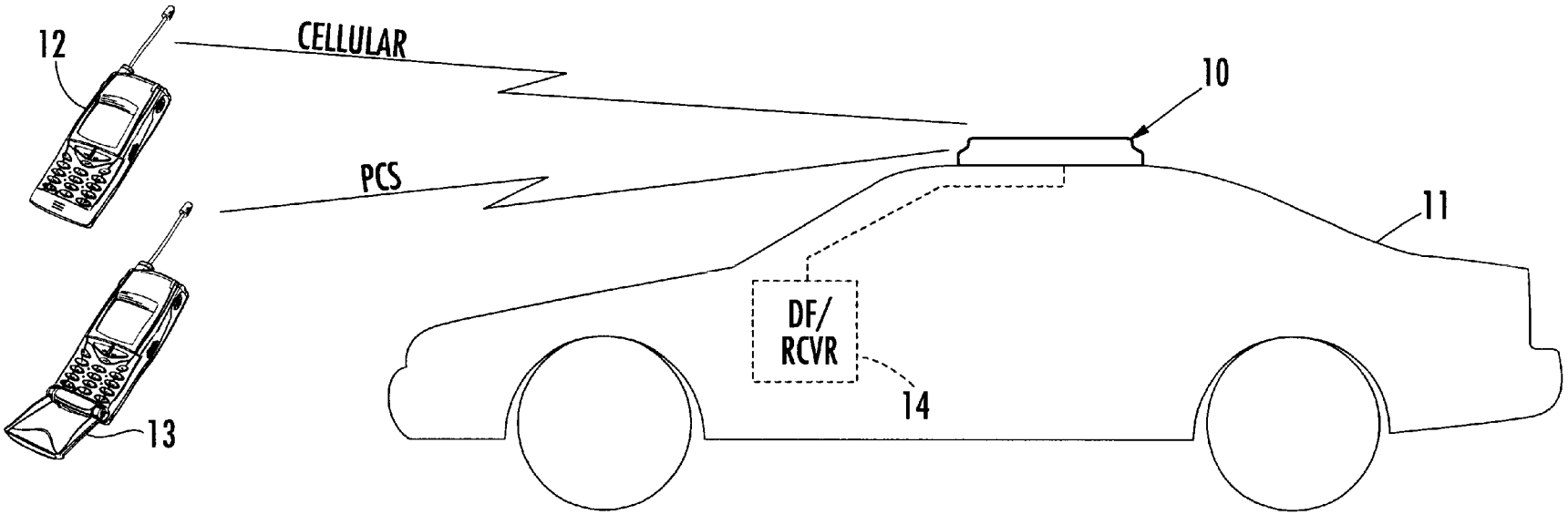
FIG. 1 is a perspective view of a multi-frequency band antenna according to the present invention mounted on a vehicle.

Referring initially to FIG. 1, a multi-frequency band antenna 10 according to the invention is illustratively shown mounted on a vehicle 11. The antenna 10 may be used for direction finding and the reception of signals from devices transmitting over multiple frequency bands, such as a cellular telephone 12 or PCS telephone 13. The vehicle 11 may include a direction finder (DF) and/or receiver 14 connected to the antenna 10 which switches the antenna between the various frequency bands. Such DF/receivers 14 are known to those of skill in the art and will therefore not be discussed further herein for clarity of explanation. The antenna 10 is particularly well suited for emergency and law enforcement applications because of its relatively low profile and performance characteristics, as will be discussed further below. Those of skill in the art will appreciate numerous other uses as well.

Figure 2:
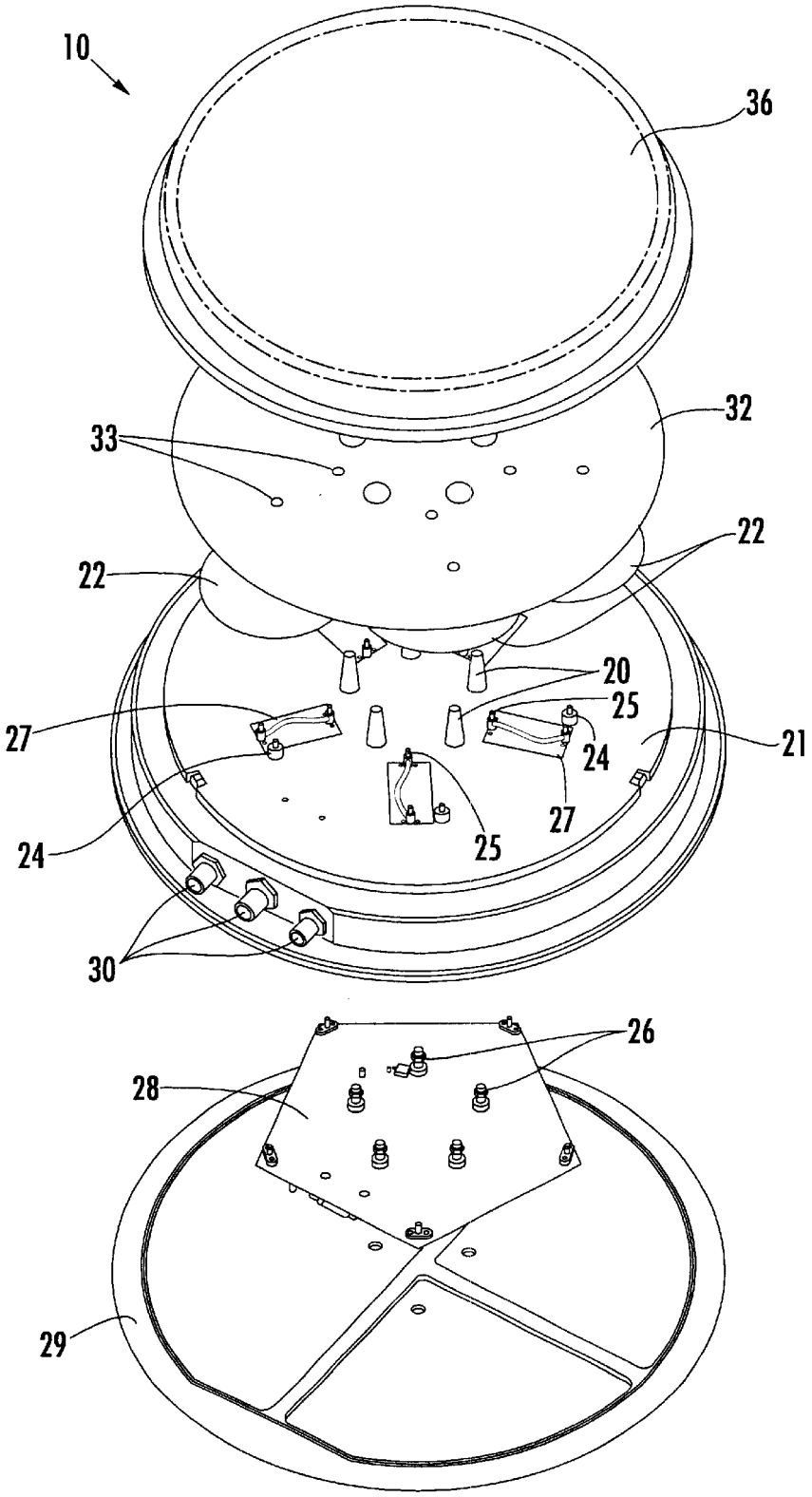
FIG. 2 is an exploded view of the multi-frequency band antenna of FIG. 1.
Figure 3:
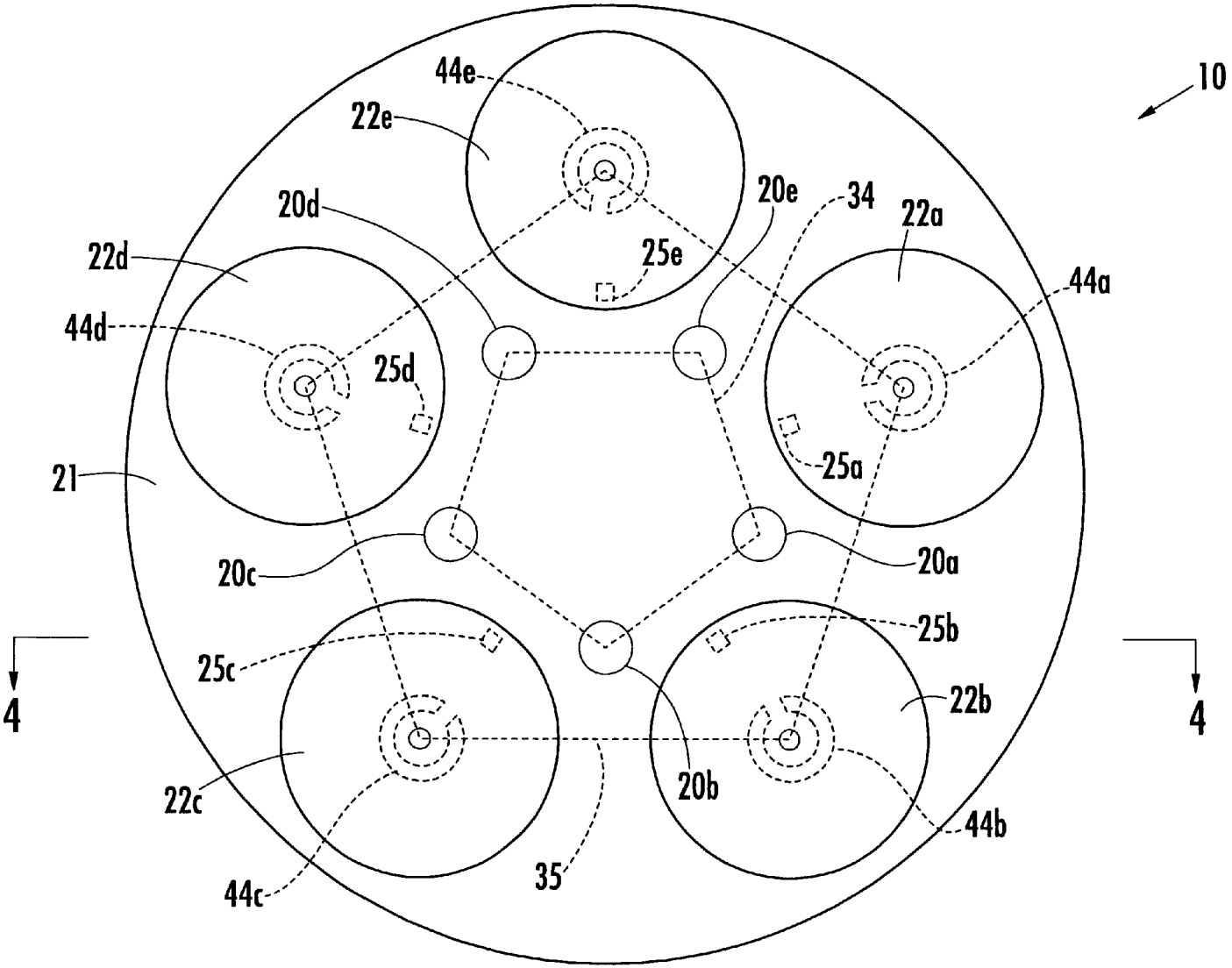
FIG. 3 is a top plan view of the multi-frequency band antenna of FIG. 1 with the radome and support plate removed to illustrate the various antenna elements.
Figure 4:
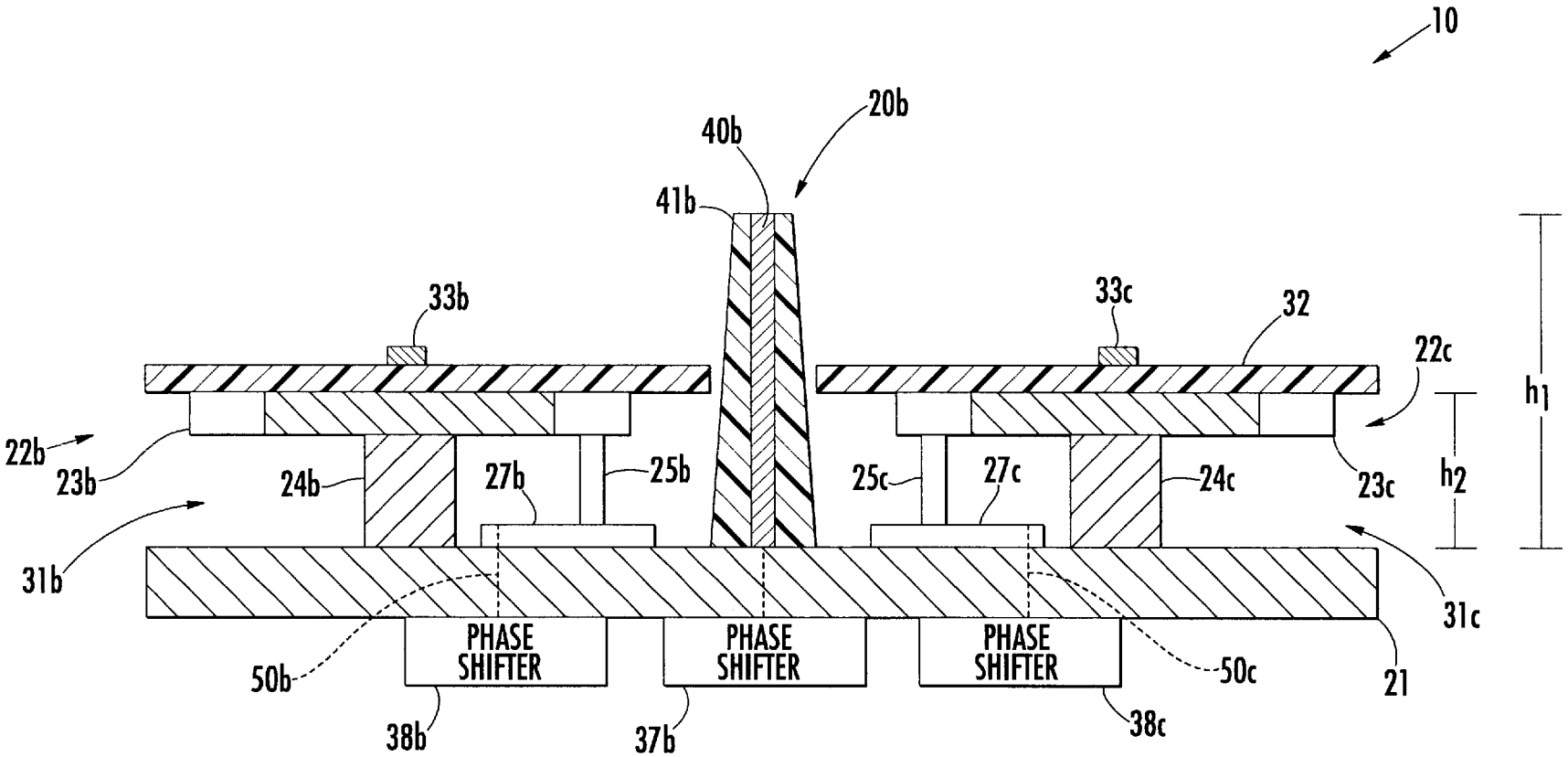
FIG. 4 is cross-sectional view of the multi-frequency band antenna taken along line 4—4 of FIG. 3.

Turning now more particularly to FIGS. 2–4, the antenna 10 illustratively includes a plurality of spaced apart monopole antenna elements 20 extending outwardly from a base 21 a first distance $h_1$ (FIG. 4). As illustratively shown, the monopole antenna elements 20 are whip antenna elements, though other suitable elements (e.g., microstrip antenna elements, slotted antenna elements, etc.) may also be used. Each of the monopole antenna elements 20 may include a conductor 40 within an insulator 41, for example (FIG. 4). Further, the antenna 10 also includes a second antenna array having a plurality of spaced apart antenna elements 22 arranged outside the first antenna array and extending outwardly from the base 21 a second distance $h_2$. The base 21 may include an electrically conductive material and serve as a ground plane for the first and second antenna arrays 20, 22.

More particularly, the first antenna array is for operating in a first frequency range, such as the PCS band. Thus, the first antenna array may be configured to receive signals in a range of about 1850 MHz to 1910 MHz, for example. The second antenna array is for operating at a second frequency (e.g., cellular frequency bands in the 800 MHz range), which is preferably lower than the first frequency. That is, improved performance characteristics are generally provided by placing the first antenna array, which operates in the higher frequency band (e.g., PCS), within the second antenna array operating in the lower frequency band (e.g., cellular), as will be appreciated by those of skill in the art. Of course, other operating frequency bands may also be used in accordance with the present invention.

Yet, as noted above, one potential drawback of such an arrangement is that outer monopole antenna elements can potentially scatter energy to be received by the inner monopole antenna elements. In accordance with the invention, the height $h_2$ of the outer antenna elements 22 may advantageously be less than the height $h_1$ of the inner monopole antenna elements 20 to reduce occurrences of such side lobes.

In this regard, the antenna elements of the second antenna array may advantageously be low profile slotted antenna elements, such as the annular slotted antenna elements 22 illustrated in FIGS. 2–4. These annular slotted antenna elements 22 exhibit similar omni-directional characteristics to those of monopole elements, yet have a lower profile. More specifically, each annular slotted antenna element 22 includes a conductive layer 23 and a shaft 24 connecting a medial portion of the conductive layer to the base 21. The conductive layer 23 is substantially parallel to the base 21. The annular slotted antenna elements 22 include respective annular slots 44 defined in the respective conductive layers 23, as illustratively shown in FIG. 3. The conductive layers 23 and slots 44 are illustratively shown with a generally circular shape in FIG. 3, but other shapes may also be used.

Because of their lower profile, the annular slotted antenna elements 22 allow the height $h_1$ of the inner monopole antenna elements 20 to remain relatively short, yet the height $h_2$ is still not so high as to cause scattering of the higher frequency band signals. For example, the monopole antenna elements 20 may have a height $h_1$ of less than about 2 inches, and, more preferably, about 1.5 inches, though the monopole elements may be shorter or taller in accordance with the invention.

Of course, it will be appreciated by those of skill in the art that while annular slotted antenna elements generally have a lower profile, they may also require more surface area (i.e., a larger footprint). As such, the choice of whether annular slotted antenna elements 22 are to be used as opposed to other suitable antenna elements known to those of skill in the art (e.g., whip antenna elements, microstrip antenna elements, other slotted antenna elements, etc.), will depend upon the particular profile and footprint requirements in a given application.

Each outer antenna element 22 of the second antenna array may also include a dielectric material 31 between an underside of the conductive layer and adjacent portions of the base. As illustratively shown in FIG. 4, the dielectric material 31 is air. Of course, other types of dielectric materials (e.g., plastic) may also be used. Further still, a combination of dielectric materials may be used, such as a first plastic dielectric material adjacent the underside of the conductive layer 23 which has a cavity therein including a second dielectric (e.g., air). Such an arrangement may advantageously be used to direct reception in a particular direction, as will be appreciated by those of skill in the art. Of course, the antenna 10 may be used for signal transmission as well.

The inner monopole antenna elements 20 of the first antenna array and the outer antenna elements 22 of the second antenna array may also be omni-directional antenna elements. As used herein, the term "omni-directional" means omni-directional within a single plane (i.e., along first and second coordinate axes), although it should be understood that the various antenna elements may also be omni-directional with respect to three coordinate axes.

Each outer antenna element 22 of the second antenna array may further include a feed conductor 25 connected adjacent a peripheral edge of the conductive layer 23 and extending to a respective impedance matching device 27. The feed conductors 25 may be secured to respective impedance matching devices 27 and outer antenna elements 22 by non-conductive fasteners (e.g., nylon) (not shown) in some embodiments where additional support is desired. Each impedance matching device 27 may in turn be connected via a respective feed through connector 50 to phase shifters 38, as will be described further below. Connectors 26 providing connections to the phase shifters 38 may be carried by a connector plate 28, for example, which may be mounted on an underside of the base 21 above a mounting plate 29. The mounting plate 29 is for coupling the base 21 to the vehicle 11, though other suitable mounting fixtures may be used as well. Connections between the antenna elements 20, 22 and the DF/receiver 14 may be facilitated via outlets 30 in the base 21.

Further, the base 21 may have an upper planar surface so that a lower end of the shafts 24 are in a generally common plane with a lower end of the inner monopole antenna elements 20, as illustratively shown in FIG. 4. Further, to provide enhanced stability for the outer antenna elements 22, in some embodiments a support plate 32 may optionally be connected to upper sides of the antenna elements via fasteners 33 (e.g., nuts). The support plate 32 is preferably made from a material which will not cause significant interference with signals being received by the inner monopole antenna elements 20, such as a dielectric material, for example. The antenna 10 may also include a radome 36 for covering the first and second antenna arrays.

The inner monopole antenna elements 20 of the first antenna array may be arranged at first vertices of a first imaginary regular polygon 34. As illustratively shown, in FIG. 3, the antenna 10 includes five inner monopole antenna elements 20*a*–20*e*, thus the first imaginary regular polygon 34 is a pentagon. Similarly, the outer antenna elements 22*a*–22*e* of the second antenna array may also be arranged at second vertices of a second imaginary regular polygon 35 concentric with the first imaginary regular polygon 34. Further, the first and second imaginary polygons 34, 35 may be angularly offset from one another to reduce coupling and pattern side lobes, as will be appreciated by those skilled in the art.

The vertices of the first and second regular imaginary polygons 34, 35 may be equal in number, and thus there are five outer antenna elements 22 illustratively shown, and the second regular imaginary polygon is also a pentagon. Of course, other numbers of inner monopole antenna elements 20 and antenna elements 22 may be used resulting in other polygonal shapes, and different numbers of antenna elements may be used in each of the first and second arrays as well.

It will be appreciated by those of skill in the art that the relative spacing of the inner monopole antenna elements 20 and outer antenna elements 22 will be driven to a large extent by the various operating frequency band and particular types of antenna elements being used. Furthermore, the first and second antenna arrays are preferably phased arrays, which may be particularly desirable for DF applications.

That is, the antenna 10 preferably includes a plurality of first controllable phase shifters 37 for controlling phases of the inner monopole antenna elements 20, as will be appreciated by those of skill in the art. Similarly, a plurality of second controllable phase shifters 38 are also illustratively included for controlling phases of the outer antenna elements 22. The controllable phase shifters may be carried on an underside of the base 21, for example, or mounting in other suitable locations in the antenna 10.

By way of example, in the illustrated embodiment (i.e., including five inner monopole antenna elements 20 and five outer antenna elements 22), the phase shifters 37, 38 may control respective phases of the first and second phased arrays to provide 360 degree azimuth coverage in both operating frequency bands. Using five antenna elements, ten consecutive beams or lobes will be generated by each antenna array substantially dividing the 360 degree area into as many sections may be desired.

A method aspect of the invention is for making a multi-frequency band antenna 10 and may include mounting a plurality of inner monopole antenna elements 20 on a base 21 in spaced relation and extending outwardly from the base a first distance $h_1$ to form a first antenna array. The first antenna array may be for operating at a first frequency. Furthermore, the method may also include mounting a plurality of outer antenna elements 22 on the base 21 in spaced relation outside the first antenna array and extending outwardly from the base a second distance $h_2$ less than the first distance $h_1$ to form a second antenna array. The second antenna array may be for operating at a second frequency lower than the first frequency, as noted above.

Yet another method aspect of the invention is for making a multi-frequency band antenna 10 which may include mounting a plurality of inner monopole antenna elements 20 in spaced relation on a base 21 and extending outwardly therefrom to form a first antenna array. The method may further include mounting a plurality of annular slotted outer antenna elements 22 in spaced relation outside the first antenna array on the base 21 and extending outwardly therefrom to form a second antenna array. The remaining aspects of the methods follow from the above description and will therefore not be discussed further herein.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A multi-frequency band antenna comprising:

a base;

a first antenna array comprising a plurality of spaced apart monopole antenna elements extending outwardly from said base a first distance and for operating at a first frequency; and a second antenna array comprising a plurality of spaced apart antenna elements arranged outside said first antenna array, extending outwardly from said base a second distance less than the first distance, and for operating at a second frequency lower than the first frequency.

2. The multi-frequency band antenna of claim 1 wherein each antenna element of said second antenna array comprises an annular slotted antenna element.

3. The multi-frequency band antenna of claim 1 wherein said monopole antenna elements of said first antenna array and said antenna elements of said second antenna array comprise omni-directional antenna elements.

4. The multi-frequency band antenna of claim 1 wherein said base comprises an electrically conductive ground plane; and wherein each antenna element of said second antenna array comprises a conductive layer and a shaft connecting a medial portion of said conductive layer to said ground plane.

5. The multi-frequency band antenna of claim 4 wherein each antenna element of said second antenna array comprises a feed conductor connected adjacent a peripheral edge of said conductive layer.

6. The multi-frequency band antenna of claim 4 wherein each antenna element of said second antenna array further comprises a dielectric material between an underside of said conductive layer and adjacent portions of said base.

7. The multi-frequency band antenna of claim 4 wherein said conductive layer has a generally circular shape.

8. The multi-frequency band antenna of claim 4 wherein said base has an upper planar surface, wherein said shaft is connected to the upper planar surface of said base so that a lower end of said shaft is in a generally common plane with a lower end of said monopole antenna elements.

9. The multi-frequency band antenna of claim 1 further comprising an impedance matching device carried by said base and connected to each antenna element of said second antenna array.

10. The multi-frequency band antenna of claim 1 wherein said plurality of monopole antenna elements of said first antenna array are arranged at first vertices of a first imaginary regular polygon.

11. The multi-frequency band antenna of claim 10 wherein said plurality of antenna elements of said second antenna array are arranged at second vertices of a second imaginary regular polygon concentric with the first imaginary regular polygon.

12. The multi-frequency band antenna of claim 11 wherein the first and second vertices are equal in number; and wherein the first and second imaginary polygons are angularly offset from one another.

13. The multi-frequency band antenna of claim 1 wherein said base comprises an electrically conductive material to serve as a ground plane for said first and second antenna arrays.

14. The multi-frequency band antenna of claim 1 further comprising a radome covering said first and second antenna arrays.

15. The multi-frequency band antenna of claim 1 further comprising a plurality of first controllable phase shifters carried by said base and for controlling phases of said monopole antenna elements of said first antenna array.

16. The multi-frequency band antenna of claim 15 further comprising a plurality of second controllable phase shifters carried by said base and for controlling phases of said antenna elements of said second antenna array.

17. A multi-frequency band antenna comprising:

a base;

a first antenna array comprising a plurality of spaced apart monopole antenna elements extending outwardly from said base; and a second antenna array comprising a plurality of spaced apart annular slotted antenna elements arranged outside said first antenna array and extending outwardly from said base.

18. The multi-frequency band antenna of claim 17 wherein said monopole antenna elements of said first antenna array operate at a first frequency, and wherein said annular slotted antenna elements of said second antenna array operate at a second frequency lower than the first frequency.

19. The multi-frequency band antenna of claim 17 wherein said monopole antenna elements extend outwardly from said base a first distance, and wherein said annular slotted antenna elements extend outwardly from said base a second distance less than the first distance.

20. The multi-frequency band antenna of claim 17 wherein said monopole antenna elements of said first antenna array and said annular slotted antenna elements of said second antenna array comprise omni-directional antenna elements.

21. The multi-frequency band antenna of claim 17 wherein said base comprises an electrically conductive ground plane; and wherein each annular slotted antenna element of said second antenna array comprises a conductive layer and a shaft connecting a medial portion of said conductive layer to said ground plane.

22. The multi-frequency band antenna of claim 21 wherein each annular slotted antenna element of said second antenna array comprises a feed conductor connected adjacent a peripheral edge of said conductive layer.

23. The multi-frequency band antenna of claim 21 wherein each annular slotted antenna element of said second antenna array further comprises a dielectric material between an underside of said conductive layer and adjacent portions of said base.

24. The multi-frequency band antenna of claim 21 wherein said conductive layer has a generally circular shape.

25. The multi-frequency band antenna of claim 21 wherein said base has an upper planar surface, wherein said shaft is connected to the upper planar surface of said base so that a lower end of said shaft is in a generally common plane with a lower end of said monopole antenna elements.

26. The multi-frequency band antenna of claim 17 further comprising an impedance matching device carried by said base and connected to each annular slotted antenna element of said second antenna array.

27. The multi-frequency band antenna of claim 17 wherein said plurality of monopole antenna elements of said first antenna array are arranged at first vertices of a first imaginary regular polygon, and wherein said plurality of annular slotted antenna elements of said second antenna array are arranged at second vertices of a second imaginary regular polygon concentric with the first imaginary regular polygon.

28. The multi-frequency band antenna of claim 27 wherein the first and second vertices are equal in number; and wherein the first and second imaginary polygons are annularly offset from one another.

29. A multi-frequency band antenna comprising:

a base;

a first antenna array comprising a plurality of spaced apart omni-directional monopole antenna elements extending outwardly from said base a first distance; and a second antenna array comprising a plurality of spaced apart omni-directional antenna elements arranged outside said first antenna array and extending outwardly from said base a second distance less than the first distance.

30. The multi-frequency band antenna of claim 29 wherein said omni-directional monopole antenna elements of said first antenna array operate at a first frequency, and wherein said omni-directional antenna elements of said second antenna array operate at a second frequency lower than the first frequency.

31. The multi-frequency band antenna of claim 29 wherein each omni-directional antenna element of said second antenna array comprises an annular slotted antenna element.

32. The multi-frequency band antenna of claim 29 wherein said base comprises an electrically conductive ground plane; and wherein each omni-directional antenna element of said second antenna array comprises a conductive layer and a shaft connecting a medial portion of said conductive layer to said ground plane.

33. The multi-frequency band antenna of claim 32 wherein each omni-directional antenna element of said second antenna array comprises a feed conductor connected adjacent a peripheral edge of said conductive layer.

34. The multi-frequency band antenna of claim 32 wherein each omni-directional antenna element of said second antenna array further comprises a dielectric material between an underside of said conductive layer and adjacent portions of said base.

35. The multi-frequency band antenna of claim 32 wherein said conductive layer has a generally circular shape.

36. The multi-frequency band antenna of claim 32 wherein said base has an upper planar surface, wherein said shaft is connected to the upper planar surface of said base so that a lower end of said shaft is in a generally common plane with a lower end of said omni-directional monopole antenna elements.

37. The multi-frequency band antenna of claim 29 further comprising an impedance matching device carried by said base and connected to each omni-directional antenna element of said second antenna array.

38. The multi-frequency band antenna of claim 29 wherein said plurality of omni-directional monopole antenna elements of said first antenna array are arranged at first vertices of a first imaginary regular polygon, and wherein said omni-directional antenna elements of said second antenna array are arranged at second vertices of a second imaginary regular polygon concentric with the first imaginary regular polygon.

39. The multi-frequency band antenna of claim 38 wherein the first and second vertices are equal in number; and wherein the first and second imaginary polygons are angularly offset from one another.

40. A method for making a multi-frequency band antenna comprising:

mounting a plurality monopole antenna elements on a base in spaced relation and extending outwardly from the base a first distance to form a first antenna array, the first antenna array for operating at a first frequency; and mounting a plurality of antenna elements on the base in spaced relation outside the first antenna array and extending outwardly from the base a second distance less than the first distance to form a second antenna array, the second antenna array for operating at a second frequency lower than the first frequency.

41. The method of claim 40 wherein each antenna element of the second antenna array comprises an annular slotted antenna element.

42. The method of claim 40 wherein the monopole antenna elements of the first antenna array and the antenna elements of the second antenna array comprise omni-directional antenna elements.

43. The method of claim 40 wherein the base comprises an electrically conductive ground plane; and wherein each antenna element of the second antenna array comprises a conductive layer and a shaft connecting a medial portion of the conductive layer to the ground plane.

44. The method of claim 40 wherein the plurality of monopole antenna elements of the first antenna array are arranged at first vertices of a first imaginary regular polygon, and wherein the plurality of antenna elements of the second antenna array are arranged at second vertices of a second imaginary regular polygon concentric with the first imaginary regular polygon.

45. A method for making a multi-frequency band antenna comprising:

mounting a plurality of monopole antenna elements in spaced relation on a base an extending outwardly therefrom to form a first antenna array; and mounting a plurality of annular slotted antenna elements in spaced relation outside the first antenna array on the base and extending outwardly therefrom to form a second antenna array.

46. The method of claim 45 wherein the monopole antenna elements of the first antenna array are for operating at a first frequency, and wherein the annular slotted antenna elements of the second antenna array are for operating at a second frequency lower than the first frequency.

47. The method of claim 45 wherein the monopole antenna elements extend outwardly from the base a first distance, and wherein the annular slotted antenna elements extend outwardly from the base a second distance less than the first distance.

48. The method of claim 45 wherein the monopole antenna elements of the first antenna array and the annular slotted antenna elements of the second antenna array comprise omni-directional antenna elements.

49. The method of claim 45 wherein the plurality of monopole antenna elements of the first antenna array are arranged at first vertices of a first imaginary regular polygon, and wherein the plurality of annular slotted antenna elements of the second antenna array are arranged at second vertices of a second imaginary regular polygon concentric with the first imaginary regular polygon.

* * * * *

UNITED STATES PATENT AND TRADEMARK OFFICE
Certificate

Patent No. 6,646,614 B2 Patented: November 11, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: William Dean Killen, Palm Bay, FL (US); and Francis Eugene Parsche, Palm Bay, FL (US).

Signed and Sealed this Fourth Day of September 2007.

DOUGLAS W. OWENS
*Supervisory Patent Examiner*
Art Unit 2821